United States Patent [19]

Ono

[11] Patent Number: 4,699,242

[45] Date of Patent: Oct. 13, 1987

[54] MAGNETIC SPEAKER

[75] Inventor: Teruaki Ono, Kakamihara, Japan

[73] Assignees: Daikin Trade & Industry Co., Ltd., Toyama; Chubu Cone Co., Ltd., Gifu, both of Japan

[21] Appl. No.: 813,960

[22] Filed: Dec. 27, 1985

[30] Foreign Application Priority Data

Dec. 28, 1984 [JP] Japan ..... 59-275211

[51] Int. Cl.[4] ..... H04R 7/06

[52] U.S. Cl. ..... 181/170; 181/167; 181/173; 381/203

[58] Field of Search ..... 181/157, 171, 173, 170, 181/180, 161, 167; 381/202–204

[56] References Cited

U.S. PATENT DOCUMENTS

| | | | |
|---|---|---|---|
| 1,500,331 | 7/1924 | Marriott | 181/173 |
| 1,690,726 | 11/1928 | Holinger | 181/173 X |
| 4,567,327 | 1/1986 | Goossens et al. | 181/173 X |

*Primary Examiner*—Benjamin R. Fuller

*Attorney, Agent, or Firm*—Birch, Stewart, Kolasch and Birch

[57] ABSTRACT

A magnetic speaker equipped with a flat diaphragm comprising a straight-grain wood plate or a cross-grain wood plate, for instance, made of Sitka spruce having the specific gravity range from 0.25 to 0.8, presenting excellent acoustic properties, especially, suitable for low to medium frequency speakers. The flat diaphragm is treated to chemically modify hydroxyl groups contained in the wooden component. Modification may be by esterification, etherification, acetilation, formalinization, or the like to enhance acoustical characteristics.

10 Claims, 21 Drawing Figures

(c)
PRIOR ART

MAGNETIC SPEAKER

BACKGROUND OF THE INVENTION

The invention relates to a flat diaphragm for use in a magnetic speaker, and more particularly to a flat diaphragm which is formed by a flat, thin sheet of wood plate having a straight-grain or cross-grain on its surface, the specific gravity of which is in the range of 0.25 to 0.8.

Paper formed in a cone shape, made from pulp, has been frequently used in a magnetic speaker (hereinafter referred to as a speaker) diaphragm, and a honeycomb construction has been used to build the flat diaphragms. Core materials for known flat diaphragms have been selected from light metals like aluminum, carbon filter reinforced plastics (CFRP), and glass fiber reinforced plastics (GFRP).

Conventionally, pulp formed into cone paper has been widely used to make speaker diaphragms because its internal friction and specific gravity are suitable for use in speakers, and the material is inexpensive. A disadvantage is that cone paper, made from pulp, lacks rigidity.

Additional disadvantages include space requirements that are large and the occurrence of a frequency turbulence characteristic, known in the industry as "front cell efficiency", generated by air resonance in the concave portion of a cone paper diaphragm. Therefore, material and construction improvements in a speaker diaphragm require the elimination of these disadvantages.

While flat honeycomb constructed diaphragms whose core material is either a light metal, like aluminum, or FRP, have less turbulent frequency characteristics than diaphragms described above, the honeycomb constructed cells resonate with each other causing turbulence within a speaker. The generated resonance may be reduced by making cells smaller, but this involves high manufacturing costs.

SUMMARY OF THE INVENTION

It is an object of this invention to provide a flat diaphragm that is stable in size and has the excellent properties of internal friction, rigidity, and specific gravity, that are suitable for use in speakers, and, at the same time, inexpensive to manufacture.

The invention is directed to materials such as coniferous wood Sitka spruce and broad-leafed Zelkova to construct a diaphragm for a speaker. As a diaphragm, a thinly sliced piece of flat wood, whose surface is formed with straight-grain or cross-grain and whose specific gravity resides within a range of 0.25 and 0.8, is mounted in a speaker.

Sitka spruce, a coniferous wood, and Zelkova, a broad-leafed wood, having specific gravities between 0.25 and 0.8, of which hydroxyl group of wood component is treated to modify in chemical process, display the following acoustic and manufacturing advantages.

A straight-grain Sitka spruce wood, for example, with 0.43 specific gravity and a large dynamic Young's modulus, about $1.25\times10^{11}$dyne/cm$^2$, forms a light and rigid diaphragm suitable for speaker application. Generally, $V=\sqrt{E/\rho}$ is the acoustic velocity, where E is the Young's modulus and $\rho$ is the a specific gravity. Because the Young's modulus of Sitka spruce is so large, compared to its specific gravity, the wood transmits sound as fast as about 5392 m/s, promoting favorable acoustic characteristics. The Sitka spruce wood internal fiction is about 6.35 $Q^{-1}\times10^{-3}$, making it suitable for use as a speaker diaphragm.

As previously mentioned, coniferous Sitka spruce wood and broad-leafed Zelkova are suitable materials for speaker diaphragms because their specific gravities are between 0.25 and 0.8. Generally, wood, with a specific gravity lower than 0.25, has rather large duct holes and air spaces, which tend to generate resonance.

Those with specific gravities larger than 0.8, relative to the Young's modulus, transmit sound slowly and are extremely hard, and therefore, these materials are difficult to process. Thus, the specific gravity range of 0.25 to 0.8 is considered to be most suitable for a speaker diaphragm.

Butt end woods in which the plane view has a grain of circles to be formed in concentric, as shown in FIG. 19(*c*), are not suitable materials for speaker diaphragms because their appearance, acoustic properties, and acoustic velocity are inferior, and because Young's modulus is small.

The above described flat diaphragm, made of Sitka spruce, has the characteristics that sound signals received in the lower frequencies are raised to a sound level in a shorter time and sound reproduction is not distorted in the diaphragm, and moreover, the diaphragm is excellent in responding to inputted sound signals compared with a honeycomb constructed diaphragm whose core materials are light metals like aluminum, so that the sound reproduced by the diaphragm of the invention is modulated, clear and genuine.

It is to be noted that Sitka spruce is a natural wood, which has a high degree of moisture absorption. If a diaphragm is made of this type of wood, and it is chemically untreated, its size is unstable, a similar property of the above described pulp-made diaphragms. This lowers the sound pressure level of the diaphragms composed of Sitka spruce. Acoustic properties change based on each situation. The reason wood absorbs moisture is because a hydroxyl group contained in the wood is bonded with water, so that the wood swells and sizes thereof change. This disadvantage may be overcome by changing the hydroxyl group to a non-hydrophilic group through chemical modification.

The chemical modification of the hydroxyl group is effected by esterifying or etherifying the hydroxyl group. Since esterification and etherification do not change the cellular structure of the wood, the diaphragm's acoustic characteristics, Young's modulus, specific gravity, and internal friction remain intact. The method stabilizes diaphragm size without adversely affecting the material's excellent acoustic qualities.

Flat diaphragms made of wood, such as Sitka spruce, which have been esterified or etherified, are especially superior to those made of light metals, such as aluminum, in honeycomb construction, because manufacturing and assembly are more easily accomplished.

In addition to Sitka spruce, other woods that display excellent acoustic qualities, may be formed into diaphragms. Additional woods can be selected from a Pine group coniferous wood, a coniferous wood such as Japanese Cryptomeria, and Japanese cypress, or broad-leafed wood such as Zelkova, Japanese lime, Buckeye, Japanese Beech, Japanese Oak. These all have a specific gravity between 0.25 and 0.8.

BRIEF DESCRIPTION OF THE DRAWINGS

These objects and features of the invention will become apparent from the following description taken in conjunction with the preferred embodiments thereof, with reference to the accompanying drawings, in which.

DETAILED DESCRIPTION OF THE INVENTION

Figure 1:
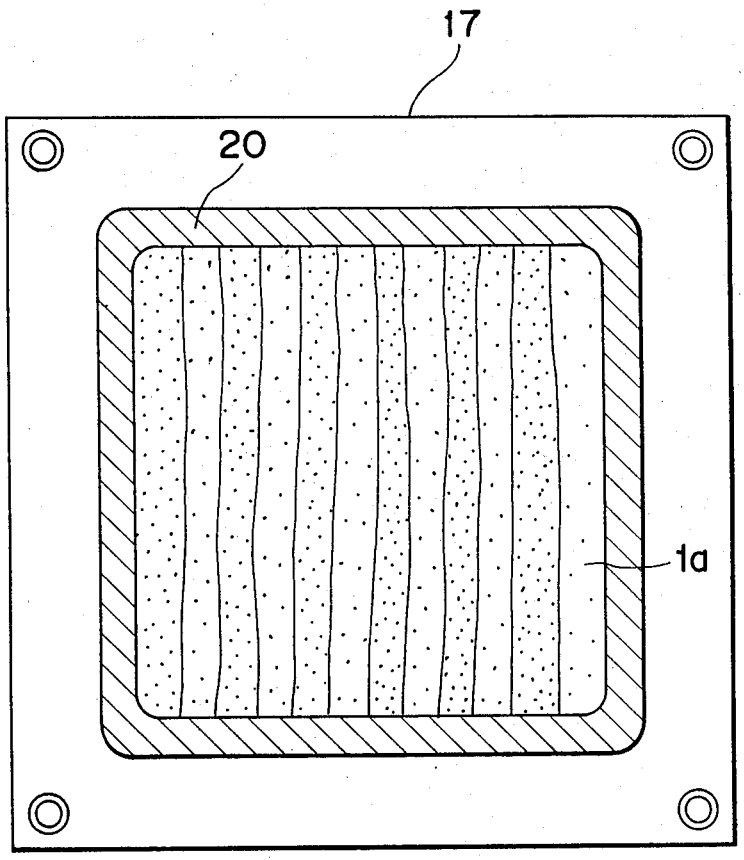
FIG. 1 is a front view of the flat diaphragm in Embodiment 1 of the invention.

Before the description of the present invention proceeds, it is to be noted that like parts are designated by like reference numerals throughout the accompanying drawings.

Hereinafter, the present invention will be described in detail with reference to the following embodiments 1 to 5, as shown in the drawings.

(EMBODIMENT 1)

Figure 2:
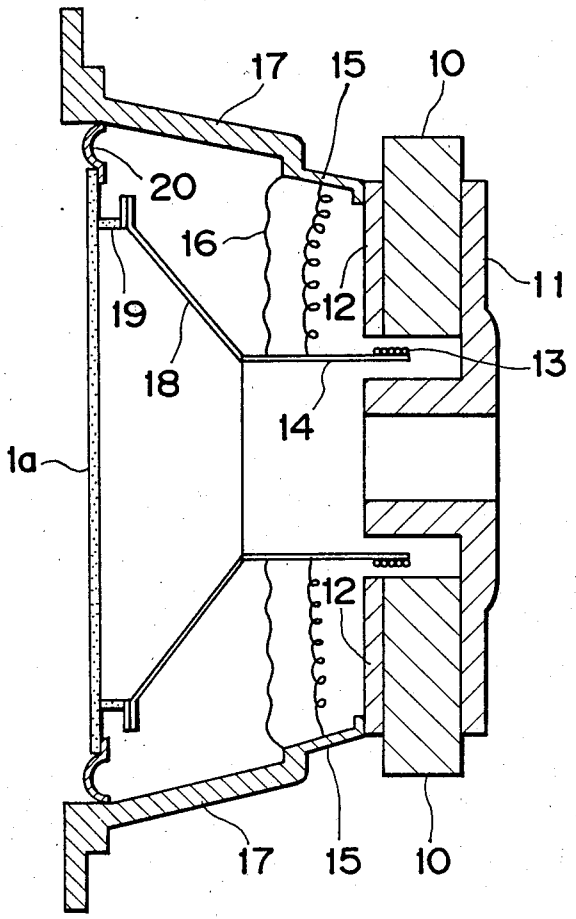
FIG. 2 is a sectional view of a speaker equipped with the diaphragm in Embodiment 1.

FIGS. 1 and 2 are drawings that show a flat diaphragm mounted on a speaker in this embodiment. FIG. 2 shows a cylindrical magnet 10, made of ferrite, mounted at the back middle of the speaker. Magnet 10 is supported and bonded by a metal yoke 11 with a hollow portion and a disc-shaped metal plate 12. Coil winding bobbin 14, having voice coil 13 bonded at the end surface thereof, is mounted in a space between yoke 11 and plate 12, and is adapted to drive in response to a sound signal to be fed through two lead wires 15.

Figure 3:
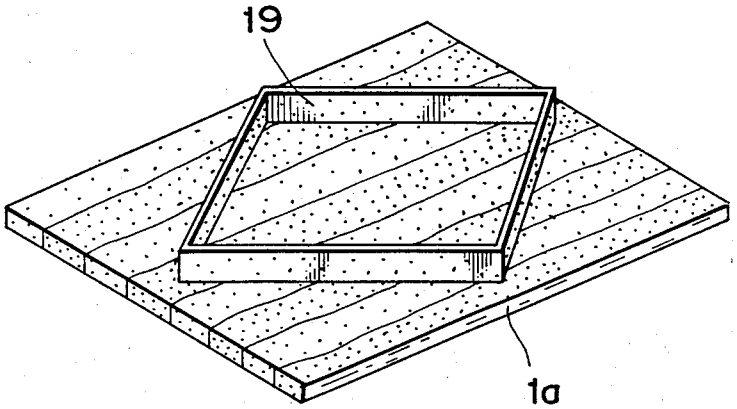
FIG. 3 is a perspective view of the support member fixed to the flat diaphragm with an adhesive agent in Embodiment 1.

Cloth-made damper 16 is fixed to the outer surface of coil winding bobbin 14, the peripheral edge of damper 16 being fixed to a metal frame 17 with an adhesive. Approximately quadrangular pyramid shaped armatures 18, made of aluminum, are fixed to the edge of coil winding bobbin 14 with an adhesive. Support member 19 is fixed to the outer periphery of armature 18 with an adhesive, as shown in FIG. 3. Power to drive coil winding bobbin 14 is transmitted to flat diaphragm 1*a*, through support member 19.

Figure 19:
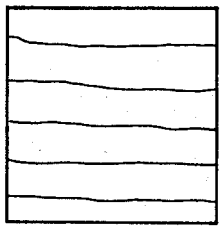
FIG. 19, (*a*) to (*c*), is plane views of wooden plates, each showing of straight-grain type (a) relating to the invention, cross-grain type (b) relating to the invention, and butt-end type (c) related to the prior art, respectively.
Figure 19:
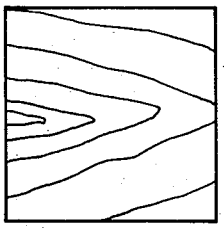
Figure 19:
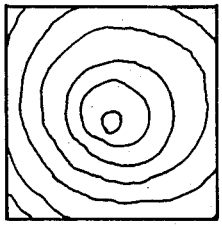

The flat diaphragm 1*a*, made of Sitka spruce, is a single sheet of wood plate having a straight-grain in parallel as shown in FIG. 19(*a*), cut square and rounded at the corners, with a thickness of 2 mm and a side length of 105 mm. The diaphragm is esterified by the following method. In this embodiment, diaphragm esterification being performed by acetilation, which is essentially the same as esterification. The peripheral edge of diaphragm 1*a* is connected to metallic frame 17 through an edge 20 made of a thin sheet of urethane foam, fixed to the peripheral portion of diaphragm 1*a*.

Hereinafter, the embodiment describes a method to acetilate a straight-grain wood plate, having each side length of 105 mm and thickness of 2 mm cut from a piece of straight-grained Sitka spruce.

A wood plate, the same size and shape as the one previously described, is placed in a pressurizer to reduce pressure in order to remove air from the wood plate, and, then, is placed in 5% (concentration by weight) sodium acetate aqueous solution to raise its pressure to the normal level in order to impregnate the solution into the wood plate.

Thereafter, the wood plate is dried until the moisture content reaches 0% and impregnated concentration of sodium acetate aqueous is 15% by weight in the wood plate. Then, pressure reduction and deaeration are simultaneously applied to the wood plate in the pressurizer for 10 minutes.

An m-xylene and acetic anhydride reaction solution of weight ratio 1:1 is put in the pressurizer and the wood plate is soaked for another 10 minutes in order to further impregnate the solution into the wood plate. The reaction solution removed from the pressurizer is heated to nearly 125° C., and returned to the pressurizer to soak and acetilate the wood plate for about 20 minutes at a constant temperature. Then, the wood plate is removed from the pressurizer, cleansed with hot water, and then dried in hot air. The result is a plate acetilated to nearly 25%, calculated by the following equation $[(W_1-W_0)\div W_0]\times 100\%$, where $W_1$ is the dry weight of the wood plate after reaction and $W_0$ is the the dry weight of the wood plate before reaction.

It is to be noted that, generally, dehydration before the reaction must be performed such that moisture content of a single wood plate is below 10%. Potassium acetate may be substituted for the acetate used in this embodiment.

Besides a solution of m-xylene and acetic anhydride mixed at the ratio of 1:1 which is used in this embodiment, other agents, such as Acetic anhydride or a mixture of anhydride and organic solvents are applicable for acetilation. Applicable organic solvents are selected from aromatic hydrocarbons such as benzene, toulene, and members of the ketone group.

Figure 4:
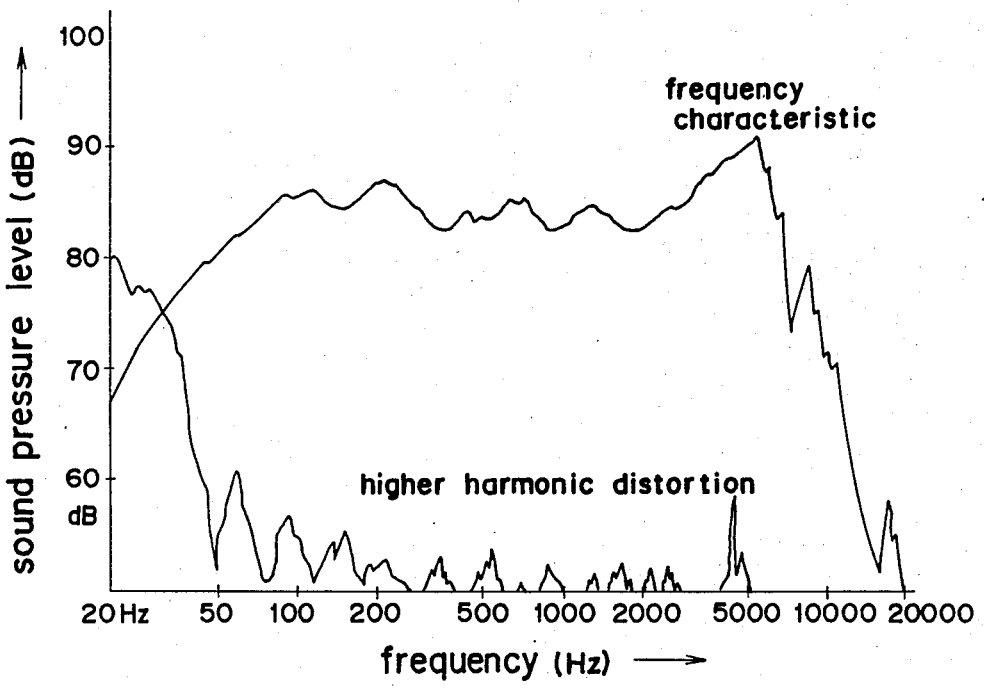
FIG. 4 is a graph showing a harmonic wave distortion curve with respect to frequency characteristics, when frequency range, received by a speaker equipped with the flat diaphragm, in Embodiment 1, is in the range from 20 Hz to 20,000 Hz.
Figure 5:
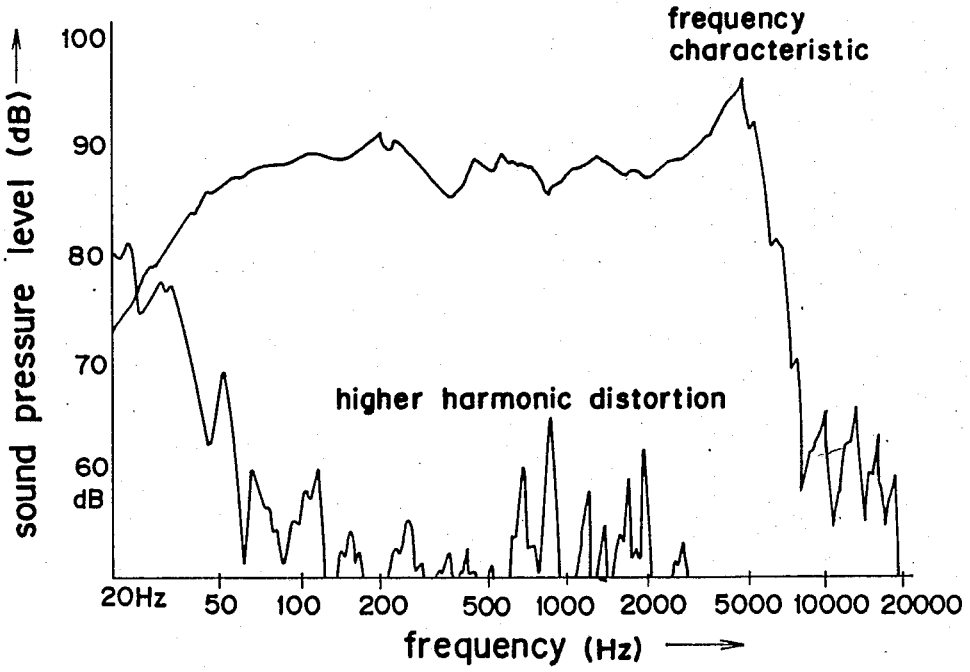
Fig.5 PRIOR ART
FIG. 5 is a graph showing a harmonic wave distortion curve with respect to frequency characteristics, when frequency range received by a speaker, equipped with a prior art honeycomb constructed diaphragm, is in the range from 20 Hz to 20,000 Hz.

FIG. 4 shows frequency charcteristics and a harmonic distortion curve from 20 Hz to 20,000 Hz, for a speaker equipped with a single flat diaphragm 1*a*, acetilated by the method as described in the embodiment. FIG. 5 shows frequency characteristics and a harmonic distortion curve from 20 Hz to 20,000 Hz, for a speaker equipped with a prior art aluminum flat diaphragm in a honeycomb construction.

As apparent from the drawings, the acoustic properties such as frequency characteristics, harmonic distortion characteristics, and sound pressure level of a speaker, equipped with embodied flat diaphragm 1*a* of the invention, are superior to the acoustics of a prior art honeycomb constructed diaphragm.

Substituting an acetyl group for the hydroxyl group in the ligneous material does not influence cell structure because of the same process performed in the embodied method. The acoustic characteristics of the flat diaphragm of the invention are not damaged in any way on the employment of the hydroxyl group in the ligneous material.

Since, by virtue of the acetilation process, factors which deteriorate acoustic characteristics of natural wood can be prevented and, also, size variation, diaphragm deformation, due to a change of humidity, and the increase in specific gravity can be prevented, the diaphragm of this invention is the most appropriate material for low to medium frequency speakers.

An agent, other than acetic anhydride, selected from groups of organic anhydrides such as propionic acid, organic acid halide, and a mixture of organic anhydrides and fatty acids, may be used as the esterifing agent in the embodiment.

(EMBODIMENT 2)

Figure 6:
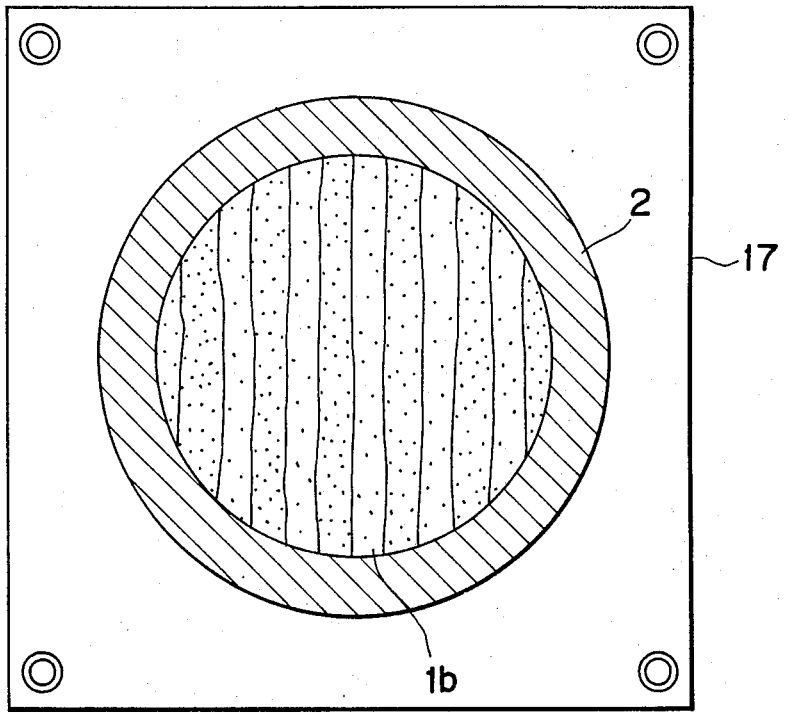
FIG. 6 is a view of the flat diaphragm in Embodiment 2.

Embodiment 2 is described with reference to FIGS. 6 through 8. FIG. 6 shows an embodiment of a flat speaker diaphragm 1*b* of the present invention. Diaphragm 1*b* consists of three single sheets of Zelkova wood plates having a cross-grain of wave forms as shown in FIG. 19(*b*), each formed of a disc having a thickness of 0.5 mm and a diameter of 100 mm. The plates are etherified and bonded wtih straight-grains crossing perpendicualr to each other. Diaphragm 1*b* is connected to metal frame 17 at edge 2 consisting of a thin sheet of urethane foam.

Figure 7:
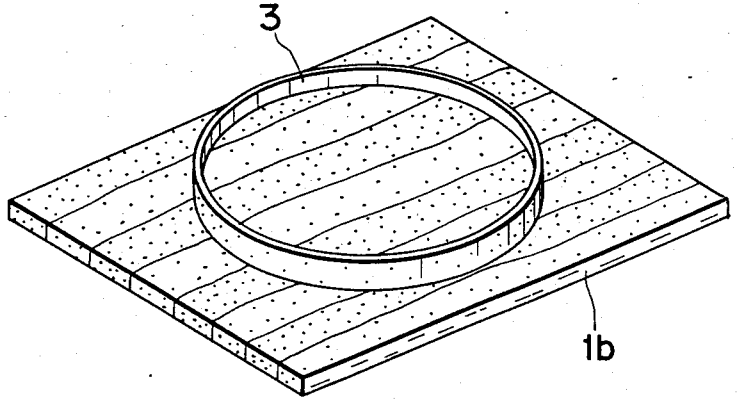
FIG. 7 is a perspective view of the support member fixed with an adhesive agent to the flat diaphragm in Embodiment 2.

As shown in FIG. 7, support member 3, made of Zelkova, is prepared and fixed to the back of flat diaphragm 1*b* with an adhesive. In addition, an approximately coneshaped aluminum armature (not shown) is fixed with an adhesive to support member 3 and transmits power, driven by a coil winding bobbin, to the flat diaphragm 1*b* therethrough.

The construction of driving members (magnet, yoke, plate, voice coil, and coil winding bobbin) are the same as those in Embodiment 1.

Hereinafter, the embodiment is described in connection with the method for etherifying a single cross-grain Zelkova plate with a thickness and diameter of 0.5 mm and 100 mm, respectively, the etherification in the method being performed by formalinization.

The single wood plate is placed in a hydrogen chloride generating device and exposed to a hydrogen chloride vapor catalyst of which concentration is 0.15 g/l. Then, the plate is impregnated with hydrogen chloride and exposed to a formaldehyde vapor at 95° C. for 10 hours, the resulting single wood plate being 60% formalinized. Three single wood plates, formalinized in the above manner, are bonded in piles with straight-grains crossing perpendicular to each other.

Agents, other than formaldehyde by which etherification is performed in this embodiment, such as alkyl halide, aromatic halogenide, and vinyl cyanide, may be used to esterify the wood plates.

The specific gravity of the single cross-grain Zelkova plate in this embodiment is 0.63 and the dynamic Young's modulus is $0.88\times10^{11}$dyne/cm$^2$. Consequently, the acoustic velocity is a little slower than plates made of Sitka spruce, however, the appearance is beautiful, and if the speaker is a wall-mountable type, the plates are applicable not only as an oscillation plate, but also as an ornamental decoration on the wall.

Figure 8:
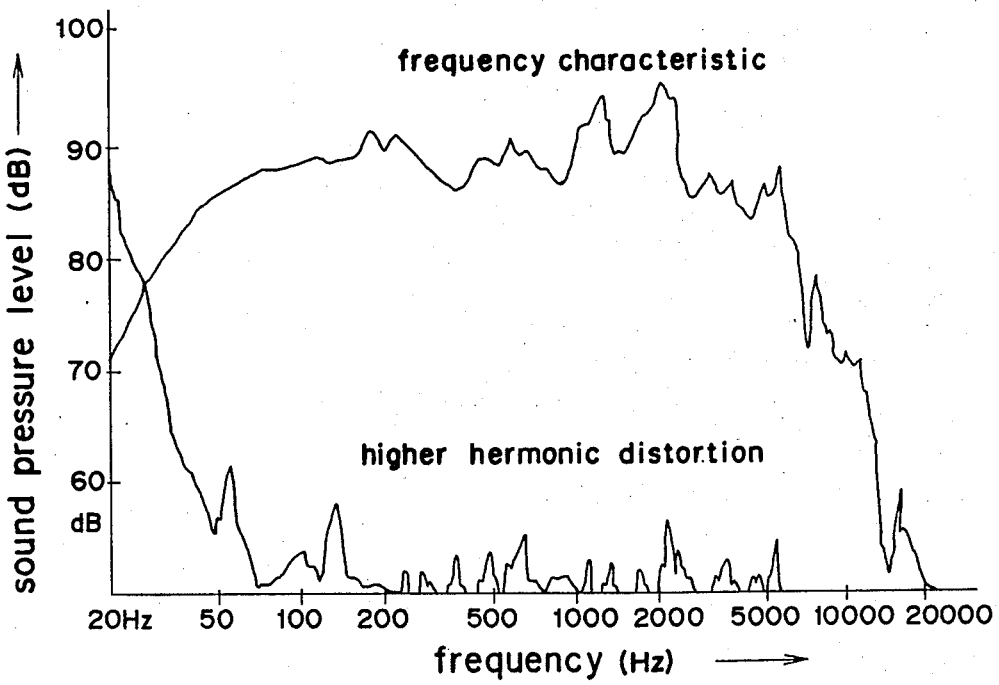
FIG. 8 is a graph showing a harmonic wave distortion curve with respect to frequency characteristics, when frequency range, received by a speaker equipped with the flat diaphragm in Embodiment 2, is in the range from 20 Hz to 20,000 Hz.
Figure 9:
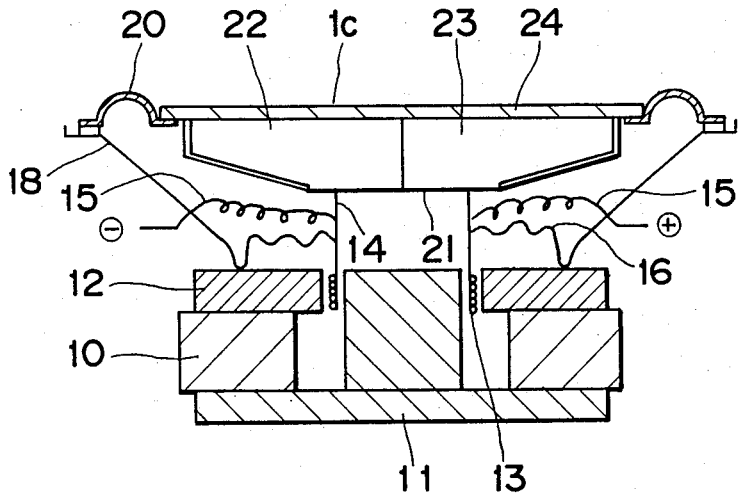
FIG. 9 is a sectional view of the speaker of Embodiment 3 in which the invention is embodied.

FIG. 8 shows frequency characteristics and a harmonic distortion curve, with a frequency range of 10 Hz to 20,000 Hz, for a speaker equipped with flat diaphragm 1*b*, which is obtained by bonding single plates into piles after formalinization.

It is apparent, when comparing FIG. 8 to FIG. 5, that the frequency characteristics, harmonic distortion curve, and sound pressure levels of a speaker equipped with flat diaphragm 1*b*, in this embodiment, are superior to those of a speaker equipped with a prior art flat diaphragm, constructed of honeycomb aluminum, as is similar in Embodiment 1. It is to be noted that, from the foregoing, the acoustic characteristics of a flat Zelkova-made diaphragm are not deteriorated by formalinization.

The above described advantage, obtained not only by formalinization, but also by the adoption of a plywood structure, prevents size variation of the diaphragm, and solves the unstable acoustic characteristic problem of natural woods, whereby sound pressure is not lowered when a diaphragm is subjected to high humidity. Thus, the flat diaphragm of the embodiment is most appropriate for a speaker for low to medium frequencies.

(EMBODIMENT 3)

Figure 10:
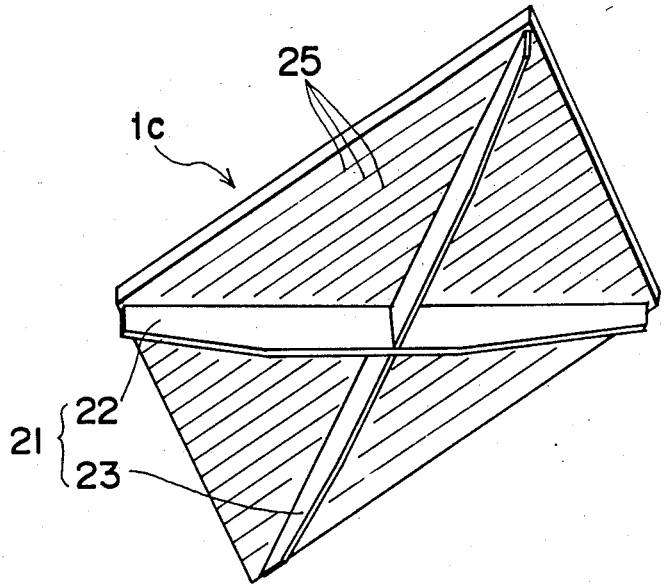
FIG. 10 is a perspective view of the diaphragm.
Figure 11:
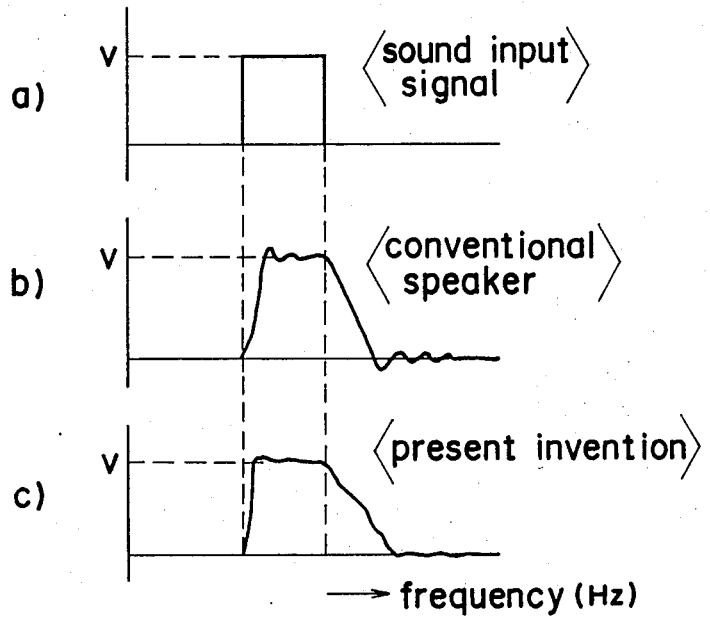
FIG. 11 is frequency characteristics curve showing acoustic characteristics difference between a prior art diaphragm and a diaphragm of the invention.

Embodiment 3 is described with reference to FIGS. 9 through 12. As shown in FIG. 10, flat diaphragm 1*c* consists of one oblong plate 24 of Sitka spruce, and is mounted on frame 18, through circular edge 20. Support member 21, consisting of support members 22, 23 made of Sitka spruce, is fixed to the back of diaphragm 1*a* with an adhesive. Support members 22, 23 extend diagonally to the straight-grain of the diaphragm and across straight-grain 25 of flat wood plate 24. Memebers 22, 23 cross at the middle thereof with each other, and are bonded to the edge of coil winding bobbin 14 near the crossed portion.

When a sound current signal is received and transmitted to driving coil 13, driving coil 13 and coil winding bobbin 14 vibrate in response to the received signal. The vibration of coil bobbin 14 is transmitted to diaphragm 1*c*, through support member 21, so that diaphragm 1*c* vibrates. Thus, the received sound is reproduced at the front face of diaphragm 1c. A moisture-proofing mixture, consisting of water glass and lithium, to maintain rigidity, is applied to the surface of flat wood plate 24.

Distinct and clear sounds are reproducible by a speaker constructed in this embodiment, because flat plate 24 of diaphragm 1c, is made of Sitka spruce which has excellent acoustic characteristics.

Diaphragm strength is the same throughout the entire diaphragm because members 22, 23 and supporting member 21, are bonded to the back of diaphragm 1c, such that straight-grains 25 of the flat wood plate 24 diagonally extend to cross with members 22, 23. Thus, different vibration frequencies are not generated at the periphery of diaphragm 1c. By virtue of this structure, the highest frequency which the diaphragm can receive, can be further raised, so that the sound reproduction range can be increased and acoustic energy attenuation can be prevented, thereby obtaining higher sound pressure.

In addition, because diaphragm 1c of this embodiment is made of flat wood plate 24, sound lengthwise speed, along the straight-grain 25, is faster than sound crosswise speed. By utilizing this fact, diaphragm 1c can be formed oblong, whereby a speaker, having an appearance different from conventional circular speaker, may be manufactured. Also, a speaker manufactured in this manner enhances the decorative effect if it is mounted on a wall of a room, because the grain of the diaphragm 1c corresponds to the wall grain in a room.

The excellent acoustic characteristics and manufacturing advantages of Sitka spruce will be described, hereafter.

The specific gravity of Sitka spruce is about 0.427 and the dynamic Young's modulus is about $1.25\times10^{11}$dyne/cm$^2$, the latter being large by contrast to the former, so that the use of Sitka spruce, as a diaphragm, allows the diaphragm to have light weight and favorable rigidity. Therefore, unlike a diaphragm in honeycomb aluminum construction, cell resonance is not generated in a diaphragm made of Sitka spruce, resulting in that tone quality, reproduced by this diaphragm, is excellent. Because small size speakers have been increasingly manufactured, it has become necessary to make the size of the diaphragms small. To meet this requirement, an electromagnetic driving device, comprising a magnet, yoke, and driving coil, must be small. Speakers, of any size, based on necessity, can be produced, because even a thin Sitka spruce diaphragm can provide adequate sound pressure and a wide range of frequency sound reproductions.

Generally, the acoustic velocity is given by the equation $V=\sqrt{E/\rho}$, where E is the Young's modulus and $\rho$ is the specific gravity. Since the Young's modulus is large compared to the specific gravity thereof, the transmission velocity of sound reproduced by a Sitka spruce-made diaphragm is as fast as 5392 m/s, thereby obtaining excellent acoustic characteristics. Further, the internal friction value of Sitka spruce, $6.35Q^{-1}\times10^3$, is smaller than that of other woods. Thus, Sitka spruce is the most appropriate material for a speaker diaphragm.

Furthermore, the rising period, in the lower frequency range, of the sound pressure level fo Sitka spruce, is shorter than that of diaphragm materials used in honeycomb construction. Sitka spruce wood, at high sound pressure levels, does not generate frequency distortion, and moreover, responds to inputted sound signals accurately, so that distinct and clear sound reproduction is produced by a Sitka spruce-made diaphragm. The frequency response characteristics of prior art materials, used for honeycomb construction, and of Sitka spruce, are shown in the frequency characteristic curve in FIG. 11.

Figure 12:
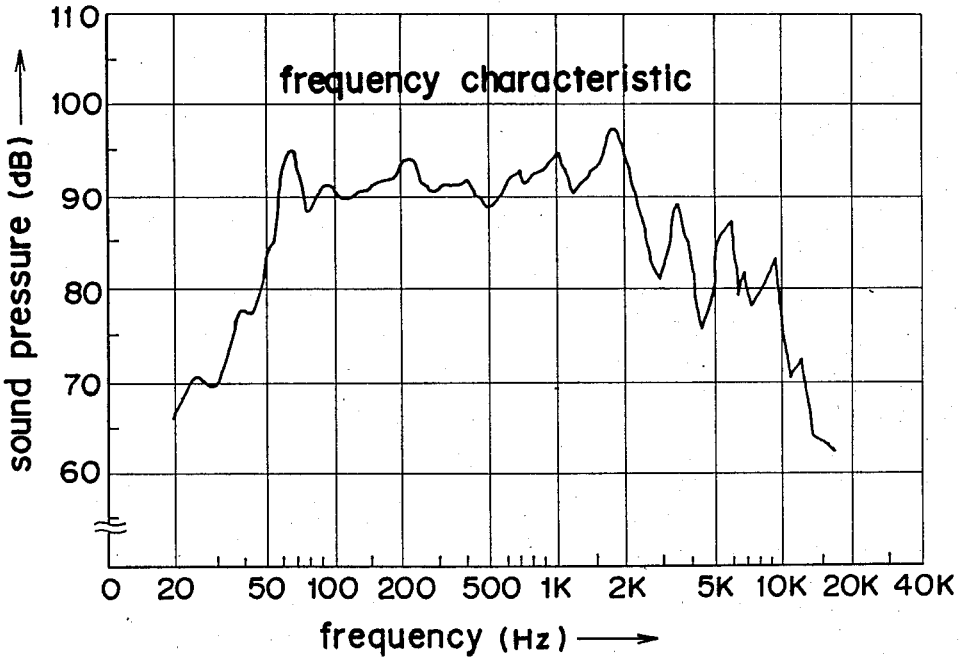
FIG. 12 is frequency characteristics curve of a diaphragm of the invention.

FIG. 12 shows a frequency characteristics curve of a diaphragm of the invention, made of square Sitka spruce, which is 2 mm in thickness and 105 mm in length, while FIG. 5 shows the frequency characteristics curve of a prior art, square diaphragm, in honeycomb construction, which is 6 mm in thickness and 105 mm in length. It is apparent, based on a comparison of FIG. 12 with FIG. 5, that a Sitka spruce-made diaphragm of the invention is in no way inferior to a honeycomb constructed diaphragm.

In addition to the above described advantages, flat diaphragm materials, made of Sitka spruce wood, are less expensive and much more easily processed, assembled, and moisture-proofed than prior art honeycomb constructed diaphragms. Also, because the grain of Sitka spruce wood harmonizes with a wooden wall grain in a room, a speaker, mounted on the wall, enhances the architectural beauty of the room.

(EMBODIMENT 4)

Figure 13:
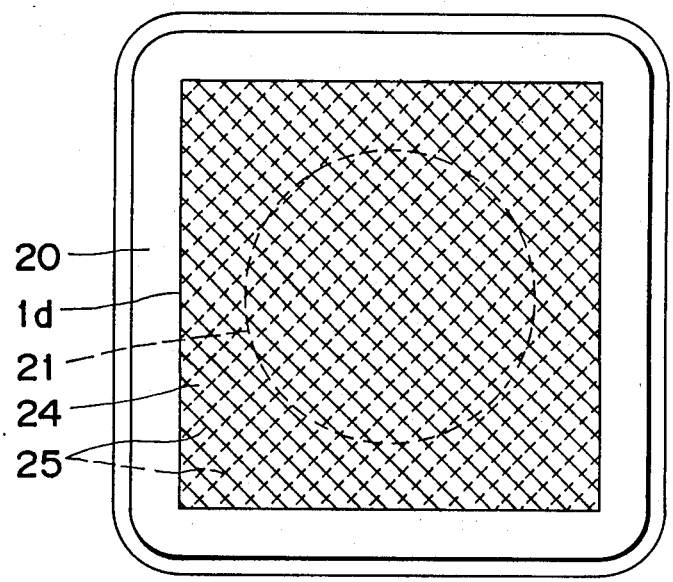
FIG. 13 is a front view showing the diaphragm in Embodiment 4.
Figure 14:
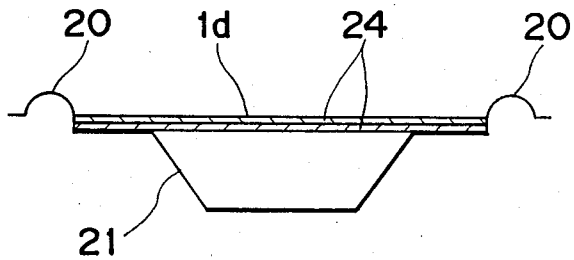
FIG. 14 is a sectional view of the diaphragm shown in FIG. 13.
Figure 15:
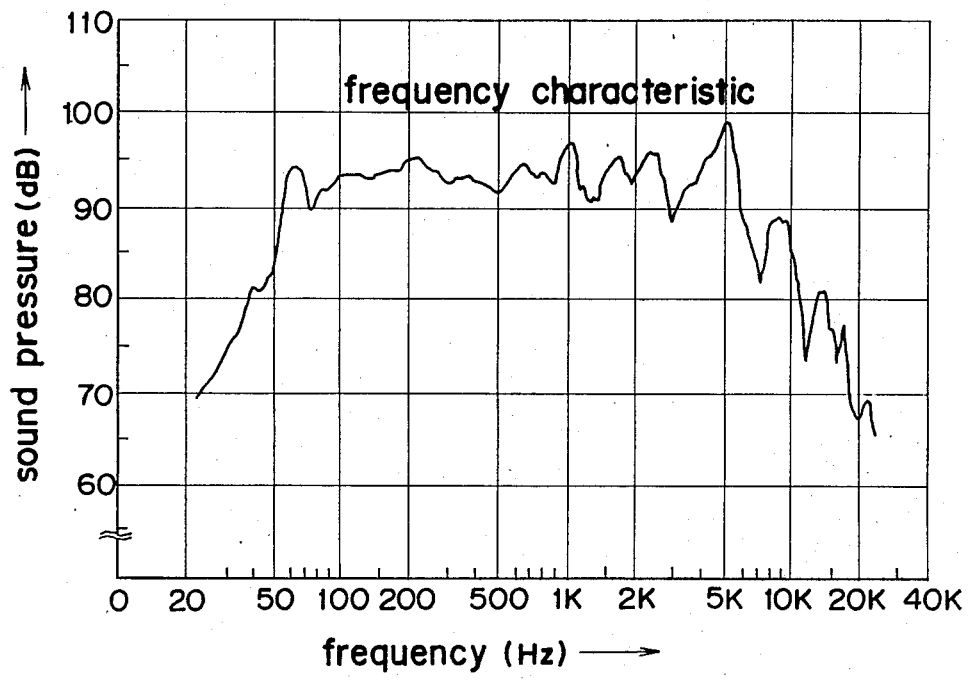
FIG. 15 is frequency characteristics curve of the diaphragm in Embodiment 4 in which the invention is embodied.

Embodiment 4 will be described with reference to FIGS. 13 through 15.

Diaphragm 1d and support member 21, described in Embodiment 4, are different in structure and shape than those described in Embodiment 3. Diaphragm 1d, in this embodiment, consists of two square Sitka spruce flat plates 24, bonded with an adhesive agent, with one plate crossing the other at a right angle. Support member 21, made of paper, is formed into a cone shape, and the end face thereof, with the largest diameter, is bonded with the inner side of diaphragm 1d, and the end face thereof, with the smallest diameter, is bonded to coil winding bobbin 14, with an adhesive. The diameter of the end face of support member 21 is $\frac{2}{3}$ the length of flat wood plate 24.

In this embodiment, because the straight-grains of bonded flat wood plates 24 cross perpendicular to each other, transmission speed of received sound is the same in each direction, and no irregularity is generated by diaphragm 1d. Further, support member 21 serves as a means for preventing the generation of different vibrations at the periphery of diaphragm 1d, as described in Embodiment 3. FIG. 15 shows a characteristics curve indicating the relationship between frequency and sound level of diaphragm 1d, which is made by bonding plates 24 together, which are 1 mm in thickness and 70 mm in diameter.

(EMBODIMENT 5)

Figure 18:
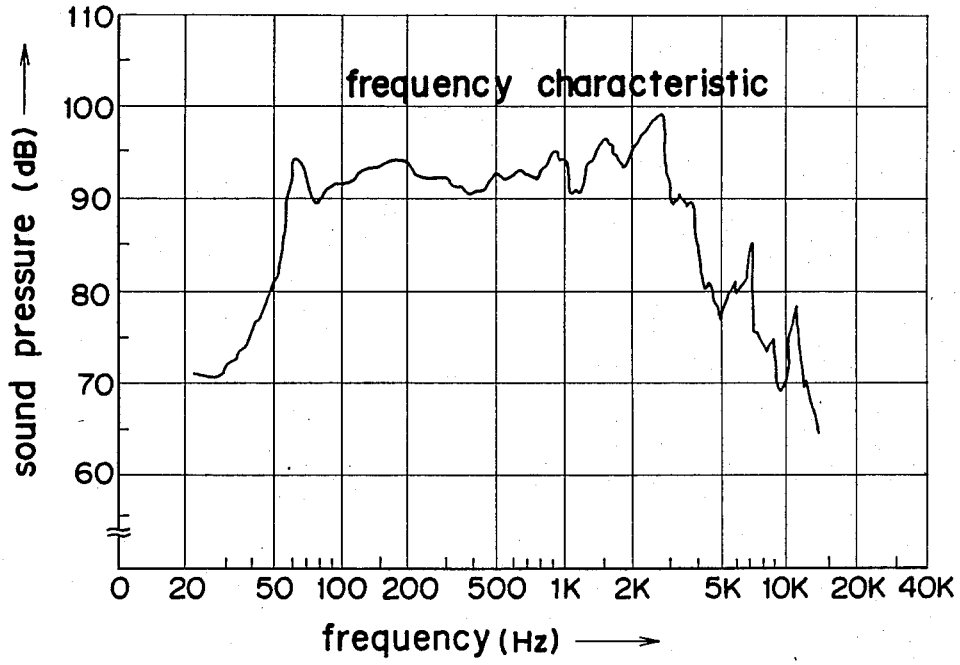
FIG. 18 is frequency characteristics curve of the diaphragm of Embodiment 5 in which the invention is embodied.
Figure 16:
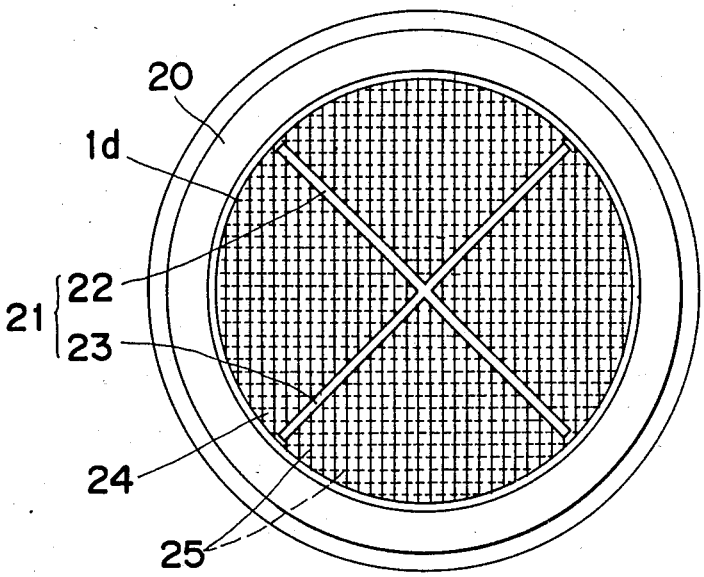
FIG. 16 is a bottom view of the diaphragm in Embodiment 5.
Figure 17:
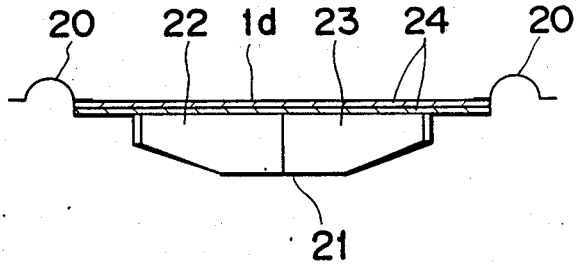
FIG. 17 is a sectional view of the diaphragm shown in FIG. 17.

Embodiment 5 will be described with reference to FIGS. 16 through 18.

Diaphragm 1e, in this embodiment, is made of two circular Sitka spruce flat wood plates 24 that are bonded to each other with an adhesvie, such that the straight-grains 25 of flat wood plates 24, cross at right angles. Support member 21, consisting of a pair of Sitka spruce-made support members 22 and 23, cross at right angles in the center of diaphragm 1e, and are bonded to the back of diaphragm 1e with an adhesive agent, support members 22 and 23 being crossed with the grains 25 of flat wood plates 24 at a 45° angle, respectively. Like in Embodiment 4, support member 21, functioning to make diaphragm strength uniform through the entire diaphragm 1*e*, prevents the generation of variable vibrations at the periphery of diaphragm 1*e*. FIG. 18 shows a characteristics curve indicating the relationship between frequency and sound level of diaphragm 1*e*, made by bonding flat wood plates 24 together, which are 1 mm in thickness and 70 mm in diameter.

As described above, a speaker equipped with a diaphragm made of coniferous wood, such as Sitka spruce, has advantages such that clear and distinct sound reproduction is achieved, materials for the diaphragm are inexpensive, and manufacturing process is easy, namely, a diaphragm may be formed in any desired shape, and speaker diaphragms, made of a coniferous wood, such as Sitka spruce, or broad-leafed wood, such as Zelkova, are light and rigid, and their sound transmission speed is fast, and the internal friction is small. Further, chemical modification, by etherification and esterification, of the wood hydroxyl group, causes no change in diaphragm size, enables the diaphragm to have superior acoustic frequency characteristics, and less harmonic wave distortion, as compared to flat honeycomb constructed diaphragms, whose core materials are light metals such as aluminum or FRPs. Moreover, the diaphragm materials of the invention are inexpensive and easy to manufacture, therefore, diaphragm manufacture is accomplished at low cost, and size and shape may be varied depending on each situation. In addition, mounting a speaker, equipped with a flat diaphragm, on a wooden wall enhances the beauty of the wall because the exposed diaphragm aesthetically correpsonds to the grain of a wall in the room.

The diaphragm of the invention is not restricted to those diaphragms described in the Embodiments. Various changes and modifications will be made unless such changes and modifications depart from the gist of the invention. For example, (1) The shape of a flat diaphragm is not restricted to a square or circle, but can be of an oblong form towards the straight-grain, and a plurality of magnets may be used for more convenient operation. Many small holes may be formed on a diaphragm made of a flat wood plate so that the diaphragm may be made light.

(2) The diaphragm of the invention may be mounted on a speaker to be used for receiving not only low to medium frequencies, but also for high frequency. More specifically, the diaphragm may be mounted for receiving wide range frequencies. Because the diaphragm of the invention consists of straight-grain or cross-grain wood, a speaker may serve as ornamentation in a room. Diaphragm grain can correspond to the grain in the wall of a room, if the speaker is mounted on a wall.

(3) Not only are Sitka spruce or Zelkova woods acceptable materials for the diaphragm of the invention. Woods, whose specific gravities are in the range of 0.25 to 0.8, may also be used. These include coniferous trees belonging to the pine group, such as Spruce, Abies, Japanese larch, Japanese red pine, Japanese spruce, Fir, Japanese hemlock, and coniferous trees belonging to other groups, such as Japanese Cryptomeria, Japanese cypress, Douglas fir, Sawara and Hiba arborvitae, and broad-leafed trees, such as Shina, Buckeye, Japanese beech, Japanese oak, Elm and Birch. Generally, coniferous trees are superior to broad-leafed trees in acoustic characteristics. However, from a decorative point of view, the latter is superior to the former.

(4) To treat the surface of chipped wood, the wood's hydroxyl group is chemically modified as shown in the above embodiments, by acetilation or formalinization, but other methods, such as esterification and etherification, may be used if such methods do not damage the acoustic characteristics of a diaphragm. Applications of different colors or designs may be made to the outer surfaces of the diaphragm. Also, all the outer surface of the wood plate may be covered with paint in order to reinforce the wood plate in various conditions.

Therefore, unless otherwise such changes and modifications depart from the scope of the present invention, they should be construed as being included therein.

What is claimed is:

1. A magnetic speaker comprising:

a flat diaphragm including a plurality of wood plates made of coniferous trees, including Sitka spruce, said plurality of wood plates being adhered together such that grains of said wood plates cross each other; and a ring magnet and a voice coil connected to said flat diaphragm through a coil winding bobbin and an armature, said voice coil being inserted in a small gap within said magnet for preventing vibration of said voice coil against said magnet;

said wood plates being chemically modified to prevent moisture absorption thereby maintaining constant dimensions of said plates.

2. The magnetic speaker according to claim 1, wherein said flat diaphragm is covered with paint on the surface thereof.

3. A magnetic speaker comprising:

a flat diaphragm including a plurality of thin wood plates, wherein each of said plurality of thin wood plates is formed with a straight-grain or a cross-grain, and has a specific gravity of 0.25 to 0.8, said plurality of wood plates being adhered together such that grains of said wood plates cross each other;

said plurality of thin wood plates being chemically modified to maintain said specific gravity of 0.25 to 0.8 therein.

4. The magnetic speaker according to claim 3, wherein said plurality of thin wood plates are comprised of coniferous trees, including Sitka spruce, or broad-leafed trees, including Zelkova.

5. The magnetic speaker according to claim 3, wherein said wood plates are chemically modified with hydroxyl groups having a wooden component contained therein.

6. The magnetic speaker according to claim 5, wherein said modification is performed by acetilation.

7. The magnetic speaker according to claim 5, wherein said modification is performed by formalinization.

8. The magnetic speaker according to claim 3, wherein said modification is performed by esterification.

9. The magnetic speaker according to claim 3, wherein said modification is performed by etherification.

10. The magnetic speaker according to claim 3, wherein said flat diagram is covered with paint on the surface thereof.

* * * * *

UNITED STATES PATENT AND TRADEMARK OFFICE

CERTIFICATE OF CORRECTION

PATENT NO. : 4,699,242

DATED : Oct. 13, 1987

INVENTOR(S) : Teruaki Ono

It is certified that error appears in the above-identified patent and that said Letters Patent is hereby corrected as shown below: On the title page In section "73" please change "Daikin Trade & Industry Co., Ltd.," to --Daiken Trade & Industry Co., Ltd.,--

Signed and Sealed this

Thirteenth Day of September, 1988

*Attest:*

DONALD J. QUIGG

*Attesting Officer*

*Commissioner of Patents and Trademarks*